US011427786B2

(12) United States Patent
Piorkowski et al.

(10) Patent No.: US 11,427,786 B2
(45) Date of Patent: Aug. 30, 2022

(54) DETERGENT COMPOSITION INCLUDING A FUNCTIONAL MATERIAL ENCAPSULATED IN POLYVINYL ALCOHOL PARTICLES

(71) Applicant: Henkel AG & Co. KGaA, Duesseldorf (DE)

(72) Inventors: Daniel Thomas Piorkowski, Fairfield, CT (US); Janet Coope-Epstein, Trumbull, CT (US); Wei W. Sun, Trumbull, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 30 days.

(21) Appl. No.: 16/541,854

(22) Filed: Aug. 15, 2019

(65) Prior Publication Data

US 2021/0047587 A1 Feb. 18, 2021

(51) Int. Cl.

| | |
|---|---|
| ***C11D 1/29*** | (2006.01) |
| ***C11D 3/386*** | (2006.01) |
| ***C11D 3/20*** | (2006.01) |
| ***C11D 11/00*** | (2006.01) |
| ***C11D 17/08*** | (2006.01) |
| ***C11D 3/34*** | (2006.01) |
| ***C11D 3/37*** | (2006.01) |
| ***C11D 3/22*** | (2006.01) |

(Continued)

(52) U.S. Cl.

CPC ..... *C11D 1/29* (2013.01); *C11D 3/1246* (2013.01); *C11D 3/2068* (2013.01); *C11D 3/2096* (2013.01); *C11D 3/222* (2013.01); *C11D 3/3418* (2013.01); *C11D 3/3753* (2013.01); *C11D 3/38636* (2013.01); *C11D 3/38645* (2013.01); *C11D 11/0017* (2013.01); *C11D 17/043* (2013.01); *C11D 17/08* (2013.01)

(58) Field of Classification Search

CPC .. C11D 1/29; C11D 3/20; C11D 11/00; C11D 17/08

See application file for complete search history.

(56) References Cited

U.S. PATENT DOCUMENTS 5,376,310 A * 12/1994 Cripe ..... C11D 1/06 510/237
5,540,866 A * 7/1996 Aszman ..... C11D 1/83 510/509

(Continued)

OTHER PUBLICATIONS

International Searching Authority, PCT International Search Report, PCT/US2020/046619, dated Nov. 26, 2020, pp. 1-11, Daejeon, Republic of Korea.

*Primary Examiner* — Nicole M. Buie-Hatcher
*Assistant Examiner* — M. Reza Asdjodi
(74) *Attorney, Agent, or Firm* — Bojuan Deng

(57) ABSTRACT

A detergent composition includes a surfactant component present in an amount of from about 5 to about 70 weight percent actives based on a total weight of the composition, water present in an amount of from about 5 to about 90 weight percent based on a total weight of the composition, polyvinyl alcohol particles present in an amount of from about 0.1 to about 5 weight percent based on a total weight of the composition, and a functional material that is encapsulated in the polyvinyl alcohol particles and is chosen from enzymes, surfactants, functional polymers, and combinations thereof and present in an amount of from about 0.05 to about 2 weight percent actives based on a total weight of the composition.

11 Claims, 1 Drawing Sheet

(51) Int. Cl.
*C11D 3/12* (2006.01)
*C11D 17/04* (2006.01)

(56) References Cited

U.S. PATENT DOCUMENTS

| | | | | |
|---|---|---|---|---|
| 5,863,877 | A * | 1/1999 | Carr | C11D 17/06 510/351 |
| 7,960,329 | B2 * | 6/2011 | Smith | C11D 3/044 510/435 |
| 9,752,103 | B2 | 9/2017 | Patterson et al. | |
| 2002/0077264 | A1 * | 6/2002 | Roberts | C11D 17/045 510/296 |
| 2013/0029895 | A1 * | 1/2013 | Bettiol | C11D 3/37 510/236 |
| 2013/0269119 | A1 * | 10/2013 | Bonsall | C11D 17/0039 8/137 |
| 2014/0364353 | A1 * | 12/2014 | Patterson | C11D 1/02 510/374 |
| 2015/0111807 | A1 * | 4/2015 | Miracle | C11D 3/3723 510/325 |
| 2016/0060571 | A1 * | 3/2016 | Panandiker | C11D 3/3742 8/137 |
| 2016/0060573 | A1 * | 3/2016 | Fossum | C11D 3/373 8/137 |
| 2016/0090553 | A1 * | 3/2016 | Wang | C11D 3/378 510/296 |
| 2017/0335244 | A1 * | 11/2017 | Lant | C11D 3/50 |
| 2018/0216052 | A1 | 8/2018 | Denome et al. | |
| 2018/0334641 | A1 * | 11/2018 | Piorkowski | C11D 1/65 |
| 2019/0017001 | A1 * | 1/2019 | Camire | C11D 3/37 |
| 2021/0047587 | A1 * | 2/2021 | Piorkowski | C11D 3/38636 |

* cited by examiner

DETERGENT COMPOSITION INCLUDING A FUNCTIONAL MATERIAL ENCAPSULATED IN POLYVINYL ALCOHOL PARTICLES

TECHNICAL FIELD OF THE INVENTION

The present disclosure generally relates to a detergent composition that includes polyvinyl alcohol particles. More specifically, the disclosure relates encapsulation of a functional material in the polyvinyl alcohol particles to facilitate stability and use of the functional materials in the detergent composition with minimized negative interactions or premature breakdown.

BACKGROUND OF THE INVENTION

Many current detergent compositions include functional materials such as enzymes and functional polymers. However, not all functional materials are stable in liquid laundry detergents or in single dose laundry detergents. For example, cellulase enzymes tend to not be stable in the presence of proteases. Pectate lyase tends to not be stable in single dose laundry detergents due to a low water activity, and typically regardless of protease presence. Cationic functional materials may interact with, and destabilize, anionic materials such as those used in softening chemistries.

Moreover, even if the functional materials are well mixed, or homogenized, into the detergent compositions, they tend to settle over time thereby leading to potential uneven dosing upon use. To remedy this, various structuring agents can be used. However, these structuring agents also have the potential to affect the stability of various functional materials.

Accordingly, there remains an opportunity for improvement. Furthermore, other desirable features and characteristics of the present disclosure will become apparent from the subsequent detailed description of the disclosure and the appended claims, taken in conjunction this background of the disclosure.

SUMMARY OF THE INVENTION

This disclosure provides a detergent composition that includes a surfactant component present in an amount of from about 5 to about 70 weight percent actives based on a total weight of the composition, water present in an amount of from about 5 to about 90 weight percent based on a total weight of the composition, polyvinyl alcohol particles present in an amount of from about 0.1 to about 5 weight percent based on a total weight of the composition, and a functional material that is encapsulated in the polyvinyl alcohol particles and that is chosen from enzymes, surfactants, functional polymers, and combinations thereof and is present in an amount of from about 0.05 to about 2 weight percent actives based on a total weight of the composition.

The detergent composition exhibits superior and unexpected results. More specifically, the use of the polyvinyl alcohol surprisingly allows the functional material to be used in a variety of detergent compositions and remain stable and relatively free from interaction with, or interference from, other compounds that may be present in the detergent composition. Moreover, when used in combination with a structuring agent, the polyvinyl alcohol particles surprisingly stay in suspension of the detergent composition for weeks after formulation. In other words, in such embodiments, the polyvinyl alcohol particles do not settle to the bottom of the detergent composition. This allows for the detergent composition to be used as a liquid laundry composition with high water levels that can effectively deliver a desired and consistent amount of the functional material during every use. Moreover, the polyvinyl alcohol particles can be designed to be colored or have reflective/refractive properties, e.g. to visually cue a benefit to the consumer such as in-wash softening, detergency boost, etc.

The encapsulation of the functional material also allows the detergent composition to include a greater number and/or variety of additives to be used without as much concern about interaction, degradation, or neutralization of efficacy. For example, various functional materials may be encapsulated in different polyvinyl alcohol particles such that they do not interact with each other and/or with non-encapsulated compounds in the detergent composition. Through use of a greater number and/or variety of additives, the detergent compositions have unexpected increased cleaning, softening, whitening, and/or odor neutralizing properties. Moreover, the encapsulation technology allows for less chemicals and less complex processes to be used which reduces production complexities, times, and costs and reduces chemical waste.

BRIEF DESCRIPTION OF THE DRAWINGS

The present disclosure will hereinafter be described in conjunction with the following Figures, wherein.

DETAILED DESCRIPTION OF THE INVENTION

Figure 1:
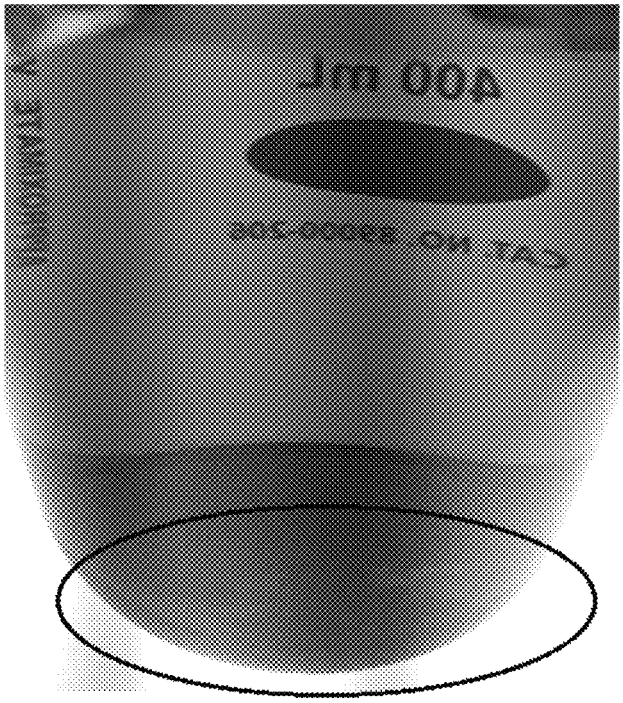
FIG. 1 is a photograph of a detergent composition of the examples that is in a container wherein particles of polyvinyl alcohol are settled at the bottom of the container as measured after allowing the comparative detergent composition to stand for 10 minutes at room temperature.

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a detergent composition that includes a functional material encapsulated in polyvinyl alcohol particles that are suspended in the detergent composition. In another aspect, the present disclosure provides a detergent composition that includes the functional material encapsulated in the polyvinyl alcohol particles that are not suspended in the detergent composition and may be, for example, free floating in the detergent composition. In still another aspect, the present disclosure provides a detergent composition that includes the functional material encapsulated in the polyvinyl alcohol particles that are settled at the bottom the detergent composition which may be acceptable for some uses, such as use in a single unit dose pack.

The detergent composition may be utilized as a liquid detergent composition with a higher water content, as is known in the art. Alternatively, the detergent composition may be utilized as a single dose detergent composition with a lower water content, as is also known in the art. For example, such a composition may be used in a unit dose pack detergent product.

In one aspect, the detergent composition includes a surfactant component present in an amount of from about 5 to about 70 weight percent actives based on a total weight of the composition, water present in an amount of from about 5 to about 90 weight percent based on a total weight of the composition, polyvinyl alcohol particles present in an amount of from about 0.1 to about 5 weight percent based on a total weight of the composition, and a functional material that is chosen from enzymes, surfactants, functional polymers, and combinations thereof and present in an amount of from about 0.05 to about 2 weight percent actives based on a total weight of the composition. The functional material is encapsulated in the polyvinyl alcohol particles.

In another aspect, the present disclosure provides a method for suspending a functional material in a detergent composition with minimal to no adverse interaction, neutralization, or reaction with other components in the detergent composition. The method includes the step of providing a functional material encapsulated in polyvinyl alcohol particles and combining the functional material encapsulated in polyvinyl alcohol particles with water and the surfactant component to form the detergent composition. Alternatively, a structuring agent or structurant may be utilized and added to the polyvinyl alcohol particles and/or the water and/or the surfactant component.

It was unexpectedly discovered that, as a result of encapsulating the functional material in the polyvinyl alcohol particles, many types of functional materials can be used in a variety of detergent compositions and remain stable and relatively free from interaction with, or interference from, other compounds that may be present in the detergent composition. It was also unexpectedly discovered that, when used in combination with a structuring agent, the polyvinyl alcohol particles surprisingly stay in suspension of the detergent composition for weeks after formulation. Moreover, the polyvinyl alcohol particles can be designed to be colored or have reflective/refractive properties, e.g. to visually cue a benefit to the consumer such as in-wash softening, detergency boost, etc.

The encapsulation of the functional material also allows the detergent composition to include a greater number and/or variety of additives to be used without as much concern about interaction, degradation, or neutralization of efficacy. For example, various functional materials may be encapsulated in different polyvinyl alcohol particles such that they do not interact with each other and/or with non-encapsulated compounds in the detergent composition. Through use of a greater number and/or variety of additives that can now be used, the detergent compositions have unexpected increased cleaning, softening, whitening, and/or odor neutralizing properties. Moreover, the encapsulation technology allows for less chemicals and less complex processes to be used which reduces production complexities, times, and costs and reduces chemical waste.

Detergent Composition

This disclosure provides the detergent composition, first introduced above and hereinafter referred to as a composition. The composition may be, include, consist essentially of, or consist of, a surfactant component, water, the polyvinyl alcohol particles and the functional material encapsulated in the polyvinyl alcohol particles, as each is described below, e.g. in any one or more of the amounts described in greater detail below.

In one embodiment, the composition comprises the surfactant component, water, the polyvinyl alcohol particles and the functional material encapsulated in the polyvinyl alcohol particles.

In another embodiment, the composition consists essentially of the surfactant component, water, the polyvinyl alcohol particles and the functional material encapsulated in the polyvinyl alcohol particles.

In still another embodiment, the composition consists of the surfactant component, water, the polyvinyl alcohol particles and the functional material encapsulated in the polyvinyl alcohol particles.

In one embodiment, the composition comprises the surfactant component including one or more of an alcohol ethoxy sulfate having a $C_8$-$C_{20}$ backbone that is ethoxylated with from about 1 to about 10 moles of ethylene oxide, a linear alkylbenzene sulfonate, and/or an ethoxylated alcohol comprising a $C_8$-$C_{20}$ backbone that is ethoxylated with from about 2 to about 12 moles of ethylene oxide, and also water, the polyvinyl alcohol particles and the functional material encapsulated in the polyvinyl alcohol particles.

In another embodiment, the composition consists essentially of the surfactant component including one or more of an alcohol ethoxy sulfate having a $C_8$-$C_{20}$ backbone that is ethoxylated with from about 1 to about 10 moles of ethylene oxide, a linear alkylbenzene sulfonate, and/or an ethoxylated alcohol comprising a $C_8$-$C_{20}$ backbone that is ethoxylated with from about 2 to about 12 moles of ethylene oxide, and also water, the polyvinyl alcohol particles and the functional material encapsulated in the polyvinyl alcohol particles.

In still another embodiment, the composition consists of the surfactant component including one or more of an alcohol ethoxy sulfate having a $C_8$-$C_{20}$ backbone that is ethoxylated with from about 1 to about 10 moles of ethylene oxide, a linear alkylbenzene sulfonate, and/or an ethoxylated alcohol comprising a $C_8$-$C_{20}$ backbone that is ethoxylated with from about 2 to about 12 moles of ethylene oxide, and also water, the polyvinyl alcohol particles and the functional material encapsulated in the polyvinyl alcohol particles.

In one embodiment, the composition comprises the surfactant component, water, a structurant, the polyvinyl alcohol particles and the functional material encapsulated in the polyvinyl alcohol particles.

In another embodiment, the composition consists essentially of the surfactant component, water, a structurant, the polyvinyl alcohol particles and the functional material encapsulated in the polyvinyl alcohol particles.

In still another embodiment, the composition consists of the surfactant component, water, a structurant, the polyvinyl alcohol particles and the functional material encapsulated in the polyvinyl alcohol particles.

In still other embodiments, the composition may comprise, consist essentially of, or consist of, any combination of components described herein, in any amounts described herein.

In further embodiments, the composition is free of, or includes less than 1, 0.5, 0.1, 0.05, or 0.01, weight percent of, any one or more of the optional components or additives described below and/or those such as, but not limited to, unencapsulated enzymes, unencapsulated surfactants, unencapsulated functional polymers, etc. or combinations thereof.

Surfactant Component

As first introduced above, the composition includes the surfactant component. The surfactant component is present in an amount of from about 5 to about 70 weight percent actives based on a total weight of the composition. In various embodiments, the surfactant component is present in an amount of from about 10 to about 65, about 15 to about 60, about 20 to about 55, about 25 to about 50, about 30 to about 45, or about 35 to about 40, weight percent actives based on a total weight of the composition. In other embodiments, the surfactant component is present in an amount of about 5 to about 15, about 10 to about 15, about 12 to about 14, or about 10 to about 14, weight percent actives based on a total weight of the composition. In still other embodiments, the surfactant component is present in an amount of about 5, about 10, about 15, about 20, about 25, about 30, about 35, about 40, about 45, about 50, about 55, about 60, about 65, or about 70, weight percent actives based on a total weight of the composition. In various non-limiting embodiments, all values, both whole and fractional, between and including all of the above, are hereby expressly contemplated for use herein.

The surfactant component may include a single surfactant, two surfactants, or more than two surfactants. Similarly, the surfactant component may include a single type or class of surfactant, two types of classes of surfactants, or more than two types or classes of surfactants, e.g. anionic, cationic, non-ionic, zwitterionic, etc. Similarly, the surfactant component may include, consist essentially of, or consist of, any one or more of the above.

In one embodiment, the surfactant component includes an alcohol ethoxy sulfate, which may be described as an anionic surfactant. The alcohol ethoxy sulfate typically has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

In some embodiments, the detergent composition is free of SLES.

In other embodiments, an additional anionic surfactant and/or a non-ionic surfactant may be utilized. However, other surfactants such as any one or more of anionic, non-ionic, cationic and/or zwitterionic (amphoteric) surfactants may also be utilized or may be excluded from the composition.

In one embodiment, surfactant component includes a linear alkylbenzene sulfonate (LAS). The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values, both whole and fractional, between and including all of the above, are hereby expressly contemplated for use herein.

In some embodiments, the detergent composition is free of LAS.

In another embodiment, the surfactant component includes a non-ionic surfactant. This non-ionic surfactant may be a $C_8$-$C_{20}$ alcohol that is capped with (or comprises) approximately 2 to 12 moles of an alkylene oxide. In other embodiments, this non-ionic surfactant is an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein. In various non-limiting embodiments, all values, both whole and fractional, between and including all of the above, are hereby expressly contemplated for use herein.

In some embodiments, the detergent composition is free of a non-ionic surfactant such as the ones described above.

In other embodiments, the surfactant component includes one or more anionic surfactants which include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

In other embodiments, the surfactant component includes nonionic surfactants such as alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the surfactant component includes a surfactant chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

In various embodiments, the surfactant component includes, consists essentially of, or consists of an alcohol ethoxy sulfate having a $C_8$-$C_{20}$ backbone that is ethoxylated with from about 1 to about 10 moles of ethylene oxide; a linear alkylbenzene sulfonate; and an ethoxylated alcohol comprising a $C_8$-$C_{20}$ backbone that is ethoxylated with from about 2 to about 12 moles of ethylene oxide. In various non-limiting embodiments, all values, both whole and fractional, between and including all of the above, are hereby expressly contemplated for use herein.

In other embodiments, the surfactant component includes, consists essentially of, or consists of:

an alcohol ethoxy sulfate having a $C_8$-$C_{20}$ backbone that is ethoxylated with from about 1 to about 10 moles of ethylene oxide and is present in an amount of from about 3 to about 5, about 3 to about 4, about 4 to about 5, or about 4 to about 6, weight percent actives based on a total weight of the composition;

a linear alkylbenzene sulfonate present in an amount of from about 0.5 to about 3, about 1 to about 2, about 0.5 to about 2, or about 1 to about 3, weight percent actives based on a total weight of the composition; and an ethoxylated alcohol comprising a $C_{12}$-$C_{15}$ backbone that is ethoxylated with from about 5 to about 10, about 5 to about 7, about 6 to about 8, or about 7, moles of ethylene oxide and is present in an amount of from about 6 to about 8, about 6 to about 7, or about 5 to about 7, weight percent actives based on a total weight of the composition.

In various non-limiting embodiments, all values, both whole and fractional, between and including all of the above, are hereby expressly contemplated for use herein.

In other embodiments, the surfactant component includes, consists essentially of, or consists of:

sodium laureth sulfate present in an amount of about 4 weight percent actives based on a total weight of the composition;

a linear alkylbenzene sulfonate present in an amount of about 2 weight percent actives based on a total weight of the composition; and an ethoxylated alcohol comprising a $C_{12}$-$C_{15}$ backbone that is ethoxylated with from about 7 moles of ethylene oxide and is present in an amount of about 7 weight percent actives based on a total weight of the composition.

In various non-limiting embodiments, all values, both whole and fractional, between and including all of the above, are hereby expressly contemplated for use herein.

Water:

Water is present in the composition in an amount of from about 5 to about 90 weight percent based on a total weight of the composition. In various embodiments, water is present in a total amount of from about 10 to about 85, about 15 to about 80, about 20 to about 75, about 25 to about 70, about 30 to about 65, about 35 to about 60, about 40 to about 55, or about 45 to about 50, weight percent based on a total weight of the composition. In other embodiments, water is present in an amount of about 5, 10, 15, 20, 25, 30, 35, 40, 45, 50, 55, 60, 65, 70, 75, 80, 85, or 90, weight percent based on a total weight of the composition.

In some embodiments, water is present in an amount of about 11 to about 18, or about 11, 12, 13, 14, 15, 16, 17, or 18 weight percent based on a total weight of the composition. In various non-limiting embodiments, all values, both whole and fractional, between and including all of the above, are hereby expressly contemplated for use herein.

In other embodiments, water is present in an amount of about 35 to about 60, or about 35, 40, 45, 50, 55, or 60, weight percent based on a total weight of the composition. In various non-limiting embodiments, all values, both whole and fractional, between and including all of the above, are hereby expressly contemplated for use herein.

The amount of water may be expressed as a total amount or any amount only relative to an amount of water added. For example, the terminology "total amount" typically refers to a total amount of water present in the composition from all components, i.e., not simply water added independently from, for example, the surfactant component. Alternatively, the amount of water may be described only as an amount of water added to the various components. In various non-limiting embodiments, all values, both whole and fractional, between and including all of the above, are hereby expressly contemplated for use herein.

Typically, a liquid laundry detergent or composition, also known as a heavy duty laundry detergent composition, has a high water content. For example, such compositions may include from about 35 to about 90 weight percent of water based on a total weight of the composition. In various embodiments, the composition includes from about 35 to about 60, about 45 to about 85, about 50 to about 80, about 55 to about 75, about 60 to about 70, or about 65 to about 70, weight percent of water based on a total weight of the composition. In various non-limiting embodiments, all values, both whole and fractional, between and including all of the above, are hereby expressly contemplated for use herein.

In other embodiments, the composition may be described as a single dose composition or a single dose laundry detergent composition, e.g. the type of be used in a single dose pack. These compositions typically have a low water content, e.g. about 5 to about 40, about 5 to about 35, or about 5 to about 30, weight percent of water based on a total weight of the composition. In various embodiments, the composition includes from about 10 to about 25, about 15 to about 25, or about 20 to about 25, weight percent based on a total weight of the composition. In other embodiments, the composition includes from about 11 to about 18, weight percent based on a total weight of the composition. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Polyvinyl Alcohol Particles

The composition also includes the polyvinyl alcohol particles. The particles are not particularly limited in shape or size.

In various embodiments, the particles are spherical, oblate (such as tabular or disc-shaped), prolate (such as rod-shaped), bladed, or equant (such as cubic or spherical shaped). Alternatively, the particles may be cut into squares, rectangles, cubes, etc., such as from pieces of a larger film.

In various embodiments, the polyvinyl alcohol particles have a particle size of from about 45 to about 150, about 150 to about 250, about 250 to about 355, about 355 to about 500, about 500 to about 710, about 710 to about 1000, or about 1000 to about 1180, nm. In other embodiments, the polyvinyl alcohol particles have a particle size of from about 200 to about 300, about 300 to about 500, about 500 to about 700, about 700 to about 1000, about 150 to about 300, about 300 to about 600, about 600 to about 100, or about 50, 100, 150, 200, 250, 300, 350, 400, 450, 500, 550, 600, 650, 700, 750, 800, 850, 900, 950, or 1000, nm. Any one or more of the aforementioned measurements may have a standard deviation of from about 30 to about 150 microns, as would be recognized and appreciated by one of skill in the art. In various non-limiting embodiments, all values, both whole and fractional, between and including all of the above, are hereby expressly contemplated for use herein.

In other embodiments, the polyvinyl alcohol particles may be alternatively described as pieces of film. For example, the film may have a length of from about 0.01 to about 0.5, about 0.05 to about 0.45, about 0.1 to about 0.4, about 0.15 to about 0.35, about 0.2 to about 0.3, or about 0.25 to about 0.3, inches. Alternatively, the film may have a length of about 0.1, 0.05, 0.1, 0.15, 0.2, 0.25, 0.3, 0.35, 0.4, 0.45, or 0.5, inches. Similarly, the film may have a width that is any value described above. In one embodiment, the film has a width and a length that are each about 0.15 inches. Moreover, the film may have any thickness. In various embodiments, the thickness is from about 30 to about 80, about 50 to about 150, or about 60 to about 120, microns. In various non-limiting embodiments, all values, both whole and fractional, between and including all of the above, are hereby expressly contemplated for use herein.

Moreover, the polyvinyl alcohol particles can be designed to be colored or have reflective/refractive properties, e.g. to visually cue a benefit to the consumer such as in-wash softening, detergency boost, etc. This can be achieved via incorporation of a compound such as mica, as chosen by one of skill in the art.

The polyvinyl alcohol particles are present in an amount of from about 0.1 to about 5 weight percent based on a total weight of the composition. In various embodiments, the polyvinyl alcohol particles are present in an amount of from about 0.1 to about 1.5, about 0.5 to about 1, about 0.25 to about 0.75, about 0.1 to about 0.5, about 0.5 to about 1, about 0.5 to about 0.75, or about 0.25 to about 0.5, weight percent based on a total weight of the composition. The weight of the polyvinyl alcohol particles is determined independent from a weight of the functional material encapsulated therein. In various non-limiting embodiments, all values, both whole and fractional, between and including all of the above, are hereby expressly contemplated for use herein.

The polyvinyl alcohol particles can exist in a high water environment based on their polymeric structure. For example, the polyvinyl alcohol particles may be about 80 to about 98, about 80 to about 90, about 81 to about 89, about 82 to about 88, about 83 to about 87, about 84 to about 86, about 85 to about 86, about 91 to about 97, about 92 to about 96, about 93 to about 95, or about 94 to about 95, percent hydrolyzed. In various embodiments, the polyvinyl alcohol particles are about 80, 81, 82, 83, 84, 85, 86, 87, 88, 89, 90, 91, 92, 93, 94, 95, 96, 97, or 98, percent hydrolyzed. When polyvinyl alcohol is made, vinyl acetate is typically polymerized to polyvinyl acetate which is then hydrolyzed such that some of the acetate groups form alcohol groups and the polyvinyl alcohol is formed. Higher percent hydrolysis leads to less solubility in water. For example, polyvinyl alcohol particles that are above about 90, e.g. about 90 to about 98, percent hydrolyzed are typically used in higher water content applications. However, polyvinyl alcohol particles that are from about 80 to about 90, percent hydrolyzed, are more soluble in water and can be used in lower water content applications, such as single dose packs. The polyvinyl alcohol particles may be any described above but are not limited to these percents of hydrolysis such that any polyvinyl alcohol particles known in the art can be used. Moreover, in various non-limiting embodiments, all values, both whole and fractional, between and including all of the above, are hereby expressly contemplated for use herein.

Functional Material

The composition further includes the functional material. The functional material typically can be described as any material that provides a benefit in the washing cycle including, but not limited to, stain removers, whitening compounds, brightening compounds, color retention compounds, softening compound, fragrances or fragrance deposition compounds, anti-redeposition compounds, etc., and combinations thereof. In various embodiments, the functional material is chosen from enzymes, surfactants, functional polymers, and combinations thereof.

In one embodiment, the functional material is an enzyme. For example, the enzyme may be any known in the art. In various embodiments, the enzyme is chosen from cellulases, lyases, and combinations thereof. In another embodiment, the enzyme is chosen from proteases, amylases, mannanases, pectinases, and combinations thereof. In another embodiment, the enzyme is chosen from proteases, amylases, mannanases, pectinases, xanthanases, and combinations thereof. The enzyme may be, for example, a pectate lyase. The enzyme may be, for example, a xanthanase.

In various embodiments, the enzyme is any amylolytic, proteolytic, cellulolytic or lipolytic. In another embodiment, the enzyme is chosen from proteases, lipases, amylases, cellulases and mixtures thereof. Alternatively, the Enzyme may be obtained from bacterial strains or fungi, such as *Bacillus subtilis, Bacillus licheniformis, Streptomyces griseus* and *Humicola insolens*. Proteases of the subtilisin type and proteases obtained from *Bacillus lentus* can also be used. Enzyme mixtures, for example mixtures of protease and amylase or protease and lipase or protease and cellulase or mixtures of cellulase and lipase or mixtures of protease, amylase and lipase or protease, lipase and cellulase, and protease- and/or lipase-containing mixtures can also be used. (Per)oxidases can also be used.

In other embodiments, the enzyme is a protease sold under the trade name Savinase by Novo Nordisk Industries A/S. Alternatively, the enzyme may be a subtillase from *Bacillus lentus*. Alternatively, the enzyme may be a protease, amylase, lipase, or cellulase, such as Alcalase (bacterial protease), Everlase (protein-engineered variant of Savinase), Esperase (bacterial protease), Lipolase (fungal lipase), Lipolase Ultra (Protein-engineered variant of Lipolase), Lipoprime (protein-engineered variant of Lipolase), Termamyl (bacterial amylase), BAN (Bacterial Amylase Novo), Celluzyme (fungal enzyme), and/or Carezyme (monocomponent cellulase), sold by Novo Nordisk Industries A/S. Also suitable for use are blends of two or more of these enzymes, for example a protease/lipase blend, a protease/amylase blend, a protease/amylase/lipase blend, and the like.

In other embodiments, the functional material is a surfactant. For example, the surfactant may be a cationic surfactant. Any type of cationic surfactant may be utilized. Alternatively, the surfactant may be any described herein. The surfactant encapsulated within the polyvinyl alcohol particles is not considered to be part of the aforementioned surfactant component.

In further embodiments, the functional material is a functional polymer. For example, the functional polymer may be a cationic polymer, a silicone, a copolymer, etc. In various embodiments, the functional polymer is a cationic cellulosic polymer, a silicone (e.g. for softening or defoaming), a polyethyleneimine, a methacrylate styrene copolymer, or combinations thereof.

The functional material is present in an amount of from about 0.05 to about 2 weight percent actives based on a total weight of the composition. In various embodiments, this amount is of from about 0.1 to about 2, about 0.1 to about 1.5, about 0.5 to about 2, about 0.5 to about 1.5, about 0.5 to about 1, about 1 to about 1.5, or about 1 to about 2, weight percent actives based on a total weight of the composition. In other embodiments, the functional material is present in an amount of 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9, 1.95, or 2, weight percent actives based on a total weight of the composition. In various non-limiting embodiments, all values, both whole and fractional, between and including all of the above, are hereby expressly contemplated for use herein.

The functional material is encapsulated in or by polyvinyl alcohol particles. Alternatively, the polyvinyl alcohol may be disposed about the functional material wherein the functional material acts as a core. It is to be understood that the terminology "disposed about" encompasses both partial and complete covering of the core or functional material by the polyvinyl alcohol. In various embodiments, the functional material is covered or otherwise enclosed inside the polyvinyl alcohol acting as a type of permeable or semipermeable membrane. Alternatively, the functional material may be described as having a uniform or approximately uniform wall surrounding it wherein the functional material may be described as a core, internal phase, or fill and wherein the polyvinyl alcohol may be described as a shell, coating, or membrane.

The polyvinyl alcohol can act as a matrix material such that the functional material is disposed within or by a matrix. For example, the functional material may be disposed within the matrix created by the polyvinyl alcohol upon production. The polyvinyl alcohol may then completely or partially dissolve upon use thereby releasing all or a portion of the functional material. It is contemplated that the variables of use such as water temperature, length of submersion in water, etc. may be customized to release all or some of the functional material at a desired rate or in a desired time frame.

The polyvinyl alcohol particles or film may be formed using any method in the art. For example, this encapsulation can occur when the polyvinyl alcohol particles are made, e.g. when a film is made and wrapped around a functional material. Any method of encapsulation known in the art can be used. In another example, the functional material may be added to the polyvinyl alcohol upon production wherein the polyvinyl alcohol is later cut or otherwise formed into sheets, particles, spheres, etc. Alternatively, the polyvinyl alcohol may be applied to the functional material e.g. by pan coating, fluidized-bed coating, co-extrusion, spraying and spinning disk encapsulation.

The polyvinyl alcohol itself may be of any weight average molecular weight. In various embodiments, the polyvinyl alcohol has a weight average molecular weight (Mw) of from about 5,000 to about 200,000 g/mol. In other embodiments, the polyvinyl alcohol has a weight average molecular weight (Mw) of from about 89,000 to about 98,000, from about 85,000 to about 124,000, from about 146,000 to about 186,000, from about 31,000 to about 50,000, from about 13,000 to about 23,000, from about 31,000 to about 50,000, from about 9,000 to about 10,000, or from about 30,000 to about 70,000. The polyvinyl alcohol may be non-hydrolyzed, partially hydrolyzed, or fully hydrolyzed. In various embodiments, suitable polyvinyl alcohol is available under the trade names of Gohsenol, Kuraray Poval, Mowiol, Selvol, Exceval, Polyviol, Sinopac, and Elvanol. In various non-limiting embodiments, all values, both whole and fractional, between and including all of the above, are hereby expressly contemplated for use herein.

In addition to the polyvinyl alcohol, the film or particles may also include or be free of one or more additional components including, but not limited to, water, glycerin, propylene glycol, saccharides, and combinations thereof. These additional components, if utilized, can be used in any amount as chosen by one of skill in the art.

Structurant

The composition may also include a structurant or structuring agent. The structurant may be any known in the art. In various embodiments, the structurant is chosen from cellulose, carboxymethylcellulose, bentonite clay, hydrogenated castor oil, and combinations thereof. In one embodiment, the structurant is cellulose. In another embodiment, the structurant is carboxymethylcellulose. In another embodiment, the structurant is bentonite clay. In another embodiment, the structurant is hydrogenated castor oil. The structurant is optional and may be utilized or may be excluded from the composition.

In various embodiments, the structurant is utilized in liquid laundry detergent compositions or compositions that are designed to be dispensed from a bottle. For example, the structurant may be used in compositions that have water contents of from about 35 to about 90 weight percent water based on a total weight of the composition. Without intending to be bound by theory, it is believed that the structurant allows the polyvinyl alcohol particles to remain suspended in the composition, e.g. even after one, two, three, four, five, six, seven, eight, or even more weeks post-formulation. In various non-limiting embodiments, all values, both whole and fractional, between and including all of the above, are hereby expressly contemplated for use herein.

The structurant may be utilized in single dose laundry detergent compositions or may be omitted. For example, the structurant may be used or omitted in compositions designed to be used in single dose packs. The structurant may be used or omitted in compositions that have lower water contents, e.g. of from about 5 to about 40, about 5 to about 35, or about 5 to about 30, weight percent of water based on a total weight of the composition. In various non-limiting embodiments, all values, both whole and fractional, between and including all of the above, are hereby expressly contemplated for use herein.

In various embodiments, the structurant is present in an amount of from about 0.5 to about 5 weight percent based on a total weight of the composition. Alternatively, the structurant may be present in an amount of from about 1 to about 4.5, about 1.5 to about 4, about 2 to about 3.5, or about 2.5 to about 3, weight percent based on a total weight of the composition. In various embodiments, the structurant is present in an amount of about 0.5, about 1, about 1.5, about 2, about 2.5, about 3, about 3.5, about 4, about 4.5, or about 5, weight percent based on a total weight of the composition. In various non-limiting embodiments, all values, both whole and fractional, between and including all of the above, are hereby expressly contemplated for use herein.

Non-Aqueous Solvent

In some embodiments, the composition may include a non-aqueous solvent. In various embodiments, the non-aqueous solvent is present in an amount of from about 1 to about 30, about 3 to about 30, about 5 to about 30, about 10 to about 25, or about 15 to about 20, weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block copolymers. In various non-limiting embodiments, all values, both whole and fractional, between and including all of the above, are hereby expressly contemplated for use herein.

In other embodiments, the composition is free of the non-aqueous solvent.

Additives:

The composition may include one or more of the following additives or may be free of one or more of the following additives. For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In various non-limiting embodiments, all values, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. The additive may be citric acid, sodium hydroxide, calcium chloride, and combinations thereof. The additive may be an anti-redeposition additive, a preservative, dye, fragrance, or combination thereof. These additives may be chosen from any known in the art and may be used in amounts as chosen by one of skill in the art.

In one embodiment, the composition is free of, or includes less than 5, 4, 3, 2, 1, 0.5, or 0.1, weight percent of, a solvent other than water, e.g. any organic solvent, non-polar solvent, polar aprotic solvent, polar protic solvent, etc. and combinations thereof. In another embodiment, the composition is free of, or includes less than 5, 4, 3, 2, 1, 0.5, or 0.1, weight percent of, propylene glycol and/or glycerine. In various non-limiting embodiments, all values, both whole and fractional, between and including all of the above, are hereby expressly contemplated for use herein.

Weight Percents/Ratios of Various Components:

The surfactant component, water, and the polyvinyl alcohol particles are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In one embodiment, the surfactant component is present in an amount of about 12 to about 13 weight percent based on a total weight of the composition, the water is present in an amount of from about 70 to about 75 weight percent based on a total weight of the composition, and the polyvinyl alcohol particles are present in an amount of about 0.5 weight percent based on a total weight of the composition. In various non-limiting embodiments, all values, both whole and fractional, between and including all of the above, are hereby expressly contemplated for use herein.

In other embodiments, the surfactant component is present in an amount of about 12 to about 13 weight percent based on a total weight of the composition, the water is present in an amount of from about 70 to about 75 weight percent based on a total weight of the composition, the polyvinyl alcohol particles are present in an amount of about 0.5 weight percent based on a total weight of the composition, and the functional material is present in an amount of from about 0.01 to about 0.1 weight percent based on a total weight of the composition, e.g. with the total film material being used at about 0.5% by weight. In various non-limiting embodiments, all values, both whole and fractional, between and including all of the above, are hereby expressly contemplated for use herein.

In further embodiments, the surfactant component includes an alcohol ethoxy sulfate having a $C_8$-$C_{20}$ backbone that is ethoxylated with from about 1 to about 10 moles of ethylene oxide and is present in an amount of from about 3 to about 5, about 3 to about 4, about 4 to about 5, or about 4 to about 6, weight percent actives based on a total weight of the composition; a linear alkylbenzene sulfonate present in an amount of from about 0.5 to about 3, about 1 to about 2, about 0.5 to about 2, or about 1 to about 3, weight percent actives based on a total weight of the composition; and an ethoxylated alcohol comprising a $C_{12}$-$C_{15}$ backbone that is ethoxylated with from about 5 to about 10, about 5 to about 7, about 6 to about 8, or about 7, moles of ethylene oxide and is present in an amount of from about 6 to about 8, about 6 to about 7, or about 5 to about 7, weight percent actives based on a total weight of the composition. In such embodiments, the water may be present in an amount of from about 70 to about 75 weight percent based on a total weight of the composition, the polyvinyl alcohol particles may be present in an amount of from about 0.5 weight percent based on a total weight of the composition, and the functional material is present in an amount of from about 0.01 to about 0.1 weight percent based on a total weight of the composition, e.g. with the total film material being used at about 0.5% by weight. In various non-limiting embodiments, all values, both whole and fractional, between and including all of the above, are hereby expressly contemplated for use herein.

In further embodiments, the surfactant component includes sodium laureth sulfate present in an amount of about 4 weight percent actives based on a total weight of the composition; a linear alkylbenzene sulfonate present in an amount of about 2 weight percent actives based on a total weight of the composition; and an ethoxylated alcohol comprising a $C_{12}$-$C_{15}$ backbone that is ethoxylated with from about 7 moles of ethylene oxide and is present in an amount of about 7 weight percent actives based on a total weight of the composition. In such embodiments, the water may be present in an amount of from about 70 to about 75 weight percent based on a total weight of the composition, the polyvinyl alcohol particles may be present in an amount of about 0.5 weight percent based on a total weight of the composition, and the functional material is present in an amount of from about 0.01 to about 0.1 weight percent based on a total weight of the composition, e.g. with the total film material being used at about 0.5% by weight. In various non-limiting embodiments, all values, both whole and fractional, between and including all of the above, are hereby expressly contemplated for use herein.

Physical Properties

Figure 2:
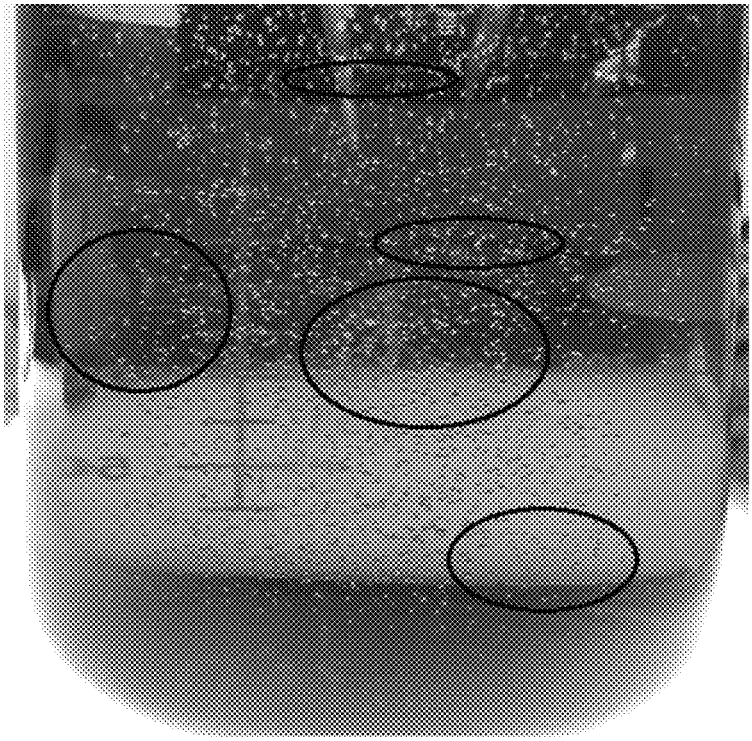
FIG. 2 is a photograph of a detergent composition of the examples that is in a container wherein particles of polyvinyl alcohol remain suspended throughout the detergent composition in the container as measured after allowing the inventive detergent composition to stand for 8 weeks at room temperature.

The composition is not particularly limited to any viscosity or any other physical properties. In various embodiments, the detergent composition includes a structurant and the polyvinyl alcohol particles are suspended in the composition measured after 0.5, 1, 2, 3, 4, 5, 6, 7, 8, or even more weeks at room temperature. The terminology "suspended" typically describes a visual assessment of the polyvinyl alcohol particles that are dispersed throughout the composition and not agglomerated or settled on a bottom of a container. For example, FIG. 2 shows one embodiment wherein the polyvinyl alcohol particles are suspended in a composition. In various non-limiting embodiments, all values, both whole and fractional, between and including all of the above, are hereby expressly contemplated for use herein.

The polyvinyl alcohol particles may be heterogeneously or consistently dispersed throughout the composition. Typically, this is preferred in liquid laundry compositions that are designed to be dispensed from a bottle. Consistently dispersed particles allows for predictable and even distribution when the compositions are used. Alternatively, the particles may be consistently disposed or settled at the bottom of a composition, such as a single dose laundry composition. With single dose laundry compositions, the same amount of the polyvinyl alcohol particles will be delivered with each single dose such that consistent dispersion or suspension in the composition is not as important or required.

Additional Embodiments:

In one embodiment, the functional material is an enzyme chosen from cellulases, lyases, and combinations thereof.

In another embodiment, the functional material is a surfactant that is cationic.

In a further embodiment, the composition includes a structurant present in an amount of from about 0.5 to about 5 weight percent based on a total weight of the composition. In a related embodiment, the structurant is chosen from cellulose, carboxymethylcellulose, bentonite clay, hydrogenated castor oil, and combinations thereof. In various non-limiting embodiments, all values, both whole and fractional, between and including all of the above, are hereby expressly contemplated for use herein.

In another embodiment, the surfactant component comprises: an alcohol ethoxy sulfate having a $C_8$-$C_{20}$ backbone that is ethoxylated with from about 1 to about 10 moles of ethylene oxide; a linear alkylbenzene sulfonate; and an ethoxylated alcohol comprising a $C_8$-$C_{20}$ backbone that is ethoxylated with from about 2 to about 12 moles of ethylene oxide. In various non-limiting embodiments, all values, both whole and fractional, between and including all of the above, are hereby expressly contemplated for use herein.

In still another embodiment, the composition is a single dose laundry detergent wherein the water is present in an amount of from about 5 to about 30 weight percent based on a total weight of the composition. In a related embodiment, the functional material is an enzyme chosen from cellulases, lyases, and combinations thereof. In another related embodiment, the functional material is a surfactant that is cationic. In a further related embodiment, the surfactant component comprises an alcohol ethoxy sulfate having a $C_8$-$C_{20}$ backbone that is ethoxylated with from about 1 to about 10 moles of ethylene oxide; a linear alkylbenzene sulfonate; and an ethoxylated alcohol comprising a $C_8$-$C_{20}$ backbone that is ethoxylated with from about 2 to about 12 moles of ethylene oxide. In a further related embodiment, the unit dose detergent pack includes a pouch made of a water-soluble film and one of the aforementioned embodiments of the detergent composition encapsulated within the pouch. For example, the detergent in the pouch may include the surfactant component including the alcohol ethoxy sulfate having a $C_8$-$C_{20}$ backbone that is ethoxylated with from about 1 to about 10 moles of ethylene oxide; a linear alkylbenzene sulfonate; and an ethoxylated alcohol comprising a $C_8$-$C_{20}$ backbone that is ethoxylated with from about 2 to about 12 moles of ethylene oxide. In various non-limiting embodiments, all values, both whole and fractional, between and including all of the above, are hereby expressly contemplated for use herein.

In another embodiment, the composition is a liquid laundry detergent wherein the water is present in an amount of from about 40 to about 90 weight percent based on a total weight of the composition. In a related embodiment, the functional material is an enzyme chosen from cellulases, lyases, and combinations thereof. In another related embodiment, the functional material is a surfactant that is cationic. In a further related embodiment, the composition includes a structurant present in an amount of from about 0.5 to about 5 weight percent based on a total weight of the composition. In another related embodiment, the structurant is chosen from cellulose, carboxymethylcellulose, bentonite clay, hydrogenated castor oil, and combinations thereof. In still another related embodiment, the surfactant component comprises an alcohol ethoxy sulfate having a $C_8$-$C_{20}$ backbone that is ethoxylated with from about 1 to about 10 moles of ethylene oxide; a linear alkylbenzene sulfonate; and an ethoxylated alcohol comprising a $C_8$-$C_{20}$ backbone that is ethoxylated with from about 2 to about 12 moles of ethylene oxide. In a further related embodiment, the unit dose detergent pack includes a pouch made of a water-soluble film and one of the aforementioned embodiments of the detergent composition encapsulated within the pouch. For example, the detergent in the pouch may include the surfactant component including the alcohol ethoxy sulfate having a $C_8$-$C_{20}$ backbone that is ethoxylated with from about 1 to about 10 moles of ethylene oxide; a linear alkylbenzene sulfonate; and an ethoxylated alcohol comprising a $C_8$-$C_{20}$ backbone that is ethoxylated with from about 2 to about 12 moles of ethylene oxide. In various non-limiting embodiments, all values, both whole and fractional, between and including all of the above, are hereby expressly contemplated for use herein.

In still another embodiment, the composition includes about 1 to about 2 weight percent of a structurant comprising cellulose and/or carboxymethylcellulose based on a total weight of the composition and wherein the polyvinyl alcohol particles are present in an amount of from about 0.25 to about 0.5 weight percent based on a total weight of the composition. In various non-limiting embodiments, all values, both whole and fractional, between and including all of the above, are hereby expressly contemplated for use herein.

In a related embodiment, water is present in an amount of from about 68 to about 72 weight percent based on a total weight of the composition and wherein the surfactant component comprises: sodium laureth sulfate ethoxylated with about 2 to about 4 moles of ethylene oxide and present in an amount of from about 3 to about 4 weight percent actives based on a total weight of the composition; a linear alkylbenzene sulfonate present in an amount of from about 1 to about 2 weight percent actives based on a total weight of the composition; and an ethoxylated alcohol comprising a $C_{12}$-$C_{15}$ backbone that is ethoxylated with about 7 moles of ethylene oxide and present in an amount of from about 6 to about 7 weight percent actives based on a total weight of the composition, and the polyvinyl alcohol particles are suspended in the detergent composition measured after 8 weeks at room temperature. In various non-limiting embodiments, all values, both whole and fractional, between and including all of the above, are hereby expressly contemplated for use herein.

Method of Forming the Detergent Composition:

This disclosure further provides a method of forming the detergent composition. The method includes the step of combining the surfactant component, water, and the polyvinyl alcohol particles wherein the functional material is encapsulated in the particles. Optionally any additional solvents, surfactants, additives, etc., may also be combined with one or more of the above to form the detergent composition. Each of the aforementioned components may be combined in any order and in whole or partial amounts. Moreover, any of the aforementioned additives may be combined as well with one or more of any compound described herein. All orders of addition are hereby expressly contemplated for use in various non-limiting embodiments.

Unit Dose Pack:

This disclosure provides a unit dose pack that includes a pouch made of a water-soluble film and a detergent composition encapsulated within the pouch, each as described above. The pouch may be the same in composition, or different from, the polyvinyl alcohol particles.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater. In various non-limiting embodiments, all values, both whole and fractional, between and including all of the above, are hereby expressly contemplated for use herein.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Method of Forming Unit Dose Pack:

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

EXAMPLES

A masterbatch composition, as set forth below in Table 1 below, is used to form a series of compositions. All values set forth in Table 1 are in parts by weight per 100 parts by weight of the Compositions not based on percent actives. More specifically, the total weight of the masterbatch composition is 97 parts with a 3 part hole that is filled with either water or with a combination of a structurant and water, as shown below.

TABLE 1

| Masterbatch Composition | Active % | w/w % |
|---|---|---|
| DI Water | 68.05 | 68.05 |
| Citric Acid | 2.25 | 4.5 |
| NaOH (50%) | 1.56 | 3.12 |
| Triethanolamine | 0.64 | 0.75 |
| C12-C15 Alcohol Ethoxylate - 7 E/O | 6.8 | 6.8 |
| Linear Alkylbenzene Sulfonate | 1.75 | 1.82 |
| Alcohol Ethoxy Sulfate | 4 | 6.67 |
| Chelator (~33 wt % actives) | 0.325 | 0.956 |
| Cocofatty Acid | 0.5 | 0.5 |
| Surfactant | 0.75 | 2 |
| Calcium Chloride | 0.05 | 0.05 |
| Anti-Redeposition Polymer | 0.075 | 0.167 |
| Preservative | 0.09 | 0.09 |
| Dye | 0.01 | 1 |
| Fragrance | 0.53 | 0.53 |
| Hole | 3 | — |

In Table 1 above, the components are as follows:

C12-C15 Alcohol Ethoxylate—7 E/O is a $C_{12}$-$C_{15}$ Alcohol Ethoxylate that is capped with approximately 7 moles of ethylene oxide.

Linear Alkylbenzene Sulfonate is 2-Phenyl Sulfonic Acid.

Alcohol Ethoxy Sulfate is sodium laureth sulfate.

Compositions 1 and 2

The aforementioned Masterbatch Composition is used to form the following Compositions 1 and 2.

Composition 1 includes 97 parts of the aforementioned masterbatch and 3 parts DI water. This acts as a control.

Composition 2 includes 97 parts of the aforementioned masterbatch, 2 parts of a cellulose structuring agent, and 1 part DI water. This acts as a negative control.

Compositions 3 and 4

After formulation, Compositions 1 and 2 are then used to formulate Compositions 3 and 4.

Composition 3 includes 99.5 parts of Composition 1 mixed with 0.5 parts of polyvinyl alcohol film cut into 0.15×0.15 inch squares.

Composition 4 includes 99.5 parts of Composition 2 mixed with 0.5 parts of polyvinyl alcohol film cut into 0.15×0.15 inch squares.

Evaluation of Compositions 3 and 4

After formulation, Compositions 3 and 4 are allowed to stand at room temperature and are observed to evaluate whether the polyvinyl alcohol squares remain suspended therein.

After approximately 10 minutes of standing at room temperature, the polyvinyl alcohol squares settled to the bottom of the container, as shown in FIG. 1. This can be acceptable in some applications, such as in single dose laundry compositions, wherein the same amount of the polyvinyl alcohol particles will be delivered with each single dose such that consistent dispersion or suspension in the composition is not as important or required.

After approximately 8+ weeks of standing at room temperature, the polyvinyl alcohol squares remained dispersed in the Composition 4 in the container, as shown in FIG. 2. This Composition produces excellent results wherein the polyvinyl alcohol particles do not settle to the bottom of the detergent composition. This allows for the detergent composition to be used as a liquid laundry composition with high water levels that can effectively deliver a desired and consistent amount of the functional material during every use.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A heavy duty laundry detergent composition comprising:

a. a surfactant component present in an amount of from about 5 to about 15 weight percent actives based on a total weight of said composition;

b. water present in an amount of from about 65 to about 75 weight percent based on a total weight of said composition;

c. polyvinyl alcohol particles present in an amount of from about 0.1 to about 5 weight percent based on a total weight of said composition; and d. a functional material that is encapsulated in said polyvinyl alcohol particles and that is chosen from enzymes, surfactants, functional polymers, and combinations thereof and present in an amount of from about 0.05 to about 2 weight percent actives based on a total weight of said composition.

2. The detergent composition of claim 1 wherein said functional material is an enzyme chosen from cellulases, lyases, and combinations thereof.

3. The detergent composition of claim 1 wherein said functional material is a surfactant that is cationic.

4. The detergent composition of claim 1 further comprising a structurant present in an amount of from about 0.5 to about 5 weight percent based on a total weight of said composition.

5. The detergent composition of claim 4 wherein said structurant is chosen from cellulose, carboxymethylcellulose, bentonite clay, hydrogenated castor oil, and combinations thereof.

6. The detergent composition of claim 1 wherein said surfactant component comprises:

an alcohol ethoxy sulfate having a $C_8$-$C_{20}$ backbone that is ethoxylated with from about 1 to about 10 moles of ethylene oxide;

a linear alkylbenzene sulfonate; and an ethoxylated alcohol comprising a $C_8$-$C_{20}$ backbone that is ethoxylated with from about 2 to about 12 moles of ethylene oxide.

7. The detergent composition of claim 1 further comprising about 1 to about 2 weight percent of a structurant comprising cellulose and/or carboxymethylcellulose based on a total weight of said composition and wherein said polyvinyl alcohol particles are present in an amount of from about 0.25 to about 0.5 weight percent based on a total weight of said composition.

8. The detergent composition of claim 7 wherein said water is present in an amount of from about 68 to about 72 weight percent based on a total weight of said composition and wherein said surfactant component comprises:

sodium laureth sulfate ethoxylated with about 2 to about 4 moles of ethylene oxide and present in an amount of from about 3 to about 4 weight percent actives based on a total weight of said composition;

a linear alkylbenzene sulfonate present in an amount of from about 1 to about 2 weight percent actives based on a total weight of said composition; and an ethoxylated alcohol comprising a $C_{12}$-$C_{15}$ backbone that is ethoxylated with about 7 moles of ethylene oxide and present in an amount of from about 6 to about 7 weight percent actives based on a total weight of said composition, and wherein said polyvinyl alcohol particles are suspended in said detergent composition measured after 8 weeks at room temperature.

9. The detergent composition of claim 1 further comprising a structurant present in an amount of from about 1 to about 2 weight percent based on a total weight of said composition.

10. The detergent composition of claim 9 wherein said structurant is a cellulose.

11. A heavy duty laundry detergent composition comprising:

a surfactant component present in an amount of from about 5 to about 15 weight percent actives based on a total weight of said composition;

water present in an amount of from about 68 to about 72 weight percent based on a total weight of said composition;

polyvinyl alcohol particles present in an amount of from about 0.1 to about 5 weight percent based on a total weight of said composition; and a functional material that is encapsulated in said polyvinyl alcohol particles and that is chosen from enzymes, surfactants, functional polymers, and combinations thereof and present in an amount of from about 0.05 to about 2 weight percent actives based on a total weight of said composition.

* * * * *